United States Patent [19]

Leblanc

[11] 4,401,082

[45] Aug. 30, 1983

[54] FUEL INJECTION PUMP FOR INTERNAL COMBUSTION ENGINES

[75] Inventor: Jean Leblanc, Lyons, France

[73] Assignee: Robert Bosch GmbH, Stuttgart, Fed. Rep. of Germany

[21] Appl. No.: 247,444

[22] Filed: Mar. 25, 1981

[30] Foreign Application Priority Data

Mar. 27, 1980 [DE] Fed. Rep. of Germany ..... 3011831

[51] Int. Cl.[3] ..... F02M 41/06

[52] U.S. Cl. ..... 123/447; 123/450; 123/459; 417/462

[58] Field of Search ..... 123/450, 457, 459, 510, 123/511, 447, 460; 417/462

[56] References Cited

U.S. PATENT DOCUMENTS

| | | | |
|---|---|---|---|
| 2,055,578 | 9/1936 | Hurst | 123/447 |
| 2,740,669 | 4/1956 | Seifert | 239/89 |
| 2,828,727 | 4/1958 | Fischer | 123/450 |
| 3,663,123 | 5/1972 | Fenne | 417/462 |
| 3,752,138 | 8/1973 | Gaines | 123/450 |
| 3,759,239 | 9/1973 | Regneault et al. | 123/447 |
| 4,043,304 | 8/1977 | Stumpp et al. | 123/505 |
| 4,309,151 | 1/1982 | Craven | 417/462 |

FOREIGN PATENT DOCUMENTS

| | | | |
|---|---|---|---|
| 547168 | 10/1957 | Canada | 123/450 |
| 1265490 | 3/1972 | United Kingdom | 417/462 |

*Primary Examiner*—Ira S. Lazarus
*Assistant Examiner*—Magdalen Moy
*Attorney, Agent, or Firm*—Edwin E. Greigg

[57] ABSTRACT

A fuel injection pump, in particular a radial-piston pump having rotating cams, is proposed in which a reservoir is incorporated in the supply line leading from the supply pump to the pump work chamber, and in which a reservoir pressure is used at the same time for restoring the outset position of the pump pistons during the intake stroke.

7 Claims, 5 Drawing Figures

FUEL INJECTION PUMP FOR INTERNAL COMBUSTION ENGINES

BACKGROUND OF THE INVENTION

The invention is an improvement upon a fuel injection pump of the type provided with a rotating distributor, which has at least one fuel reception groove therein. In a known fuel injection pump of this kind, having a multiplicity of pump pistons, the pump pistons are pushed into their outset position by springs. The supply pump, which is relatively large in dimension, must be adapted in terms of its output capacity to the output capacity of the injection pump; specifically, it must be adapted for the case where a maximum volume must flow into the pump work chamber in the shortest possible time during the course of the intake stroke, which occurs during maximum rpm and full load. In this known structure, it is particularly disadvantageous that restoring springs are used which require a relatively large amount of space not only in diameter but in the axial length as well. As a result, pump designers are presented with substantial difficulties, given increasing demands by engine manufacturers for smaller injection systems.

OBJECT AND SUMMARY OF THE INVENTION

A principal object of the fuel injection pump according to the invention is to provide a reservoir means therein makes it is possible for the supply pump to be made relatively small in size.

Another object of the invention is to provide a fuel injection pump which obviates the costs of producing a precision spring to restore the pump piston.

These objects are attained following the invention because in the periods during which the pump piston effects supply for the purpose of injection, the supply pump fills up the reservoir; then, within a relatively short period, the fuel flows into the pump work chamber from the reservoir during the intake stroke of the pump piston. Since the pump piston is pushed into its outset position by the fuel, it is possible to eliminate the restoring spring. This factor results in substantial structural advantages and minimizes the need for installation space.

The invention will be better understood and further objects and advantages thereof will become more apparent from the ensuing detailed description of two preferred embodiments taken in conjunction with the drawings.

DESCRIPTION OF THE PREFERRED EMBODIMENTS

Figure 1:
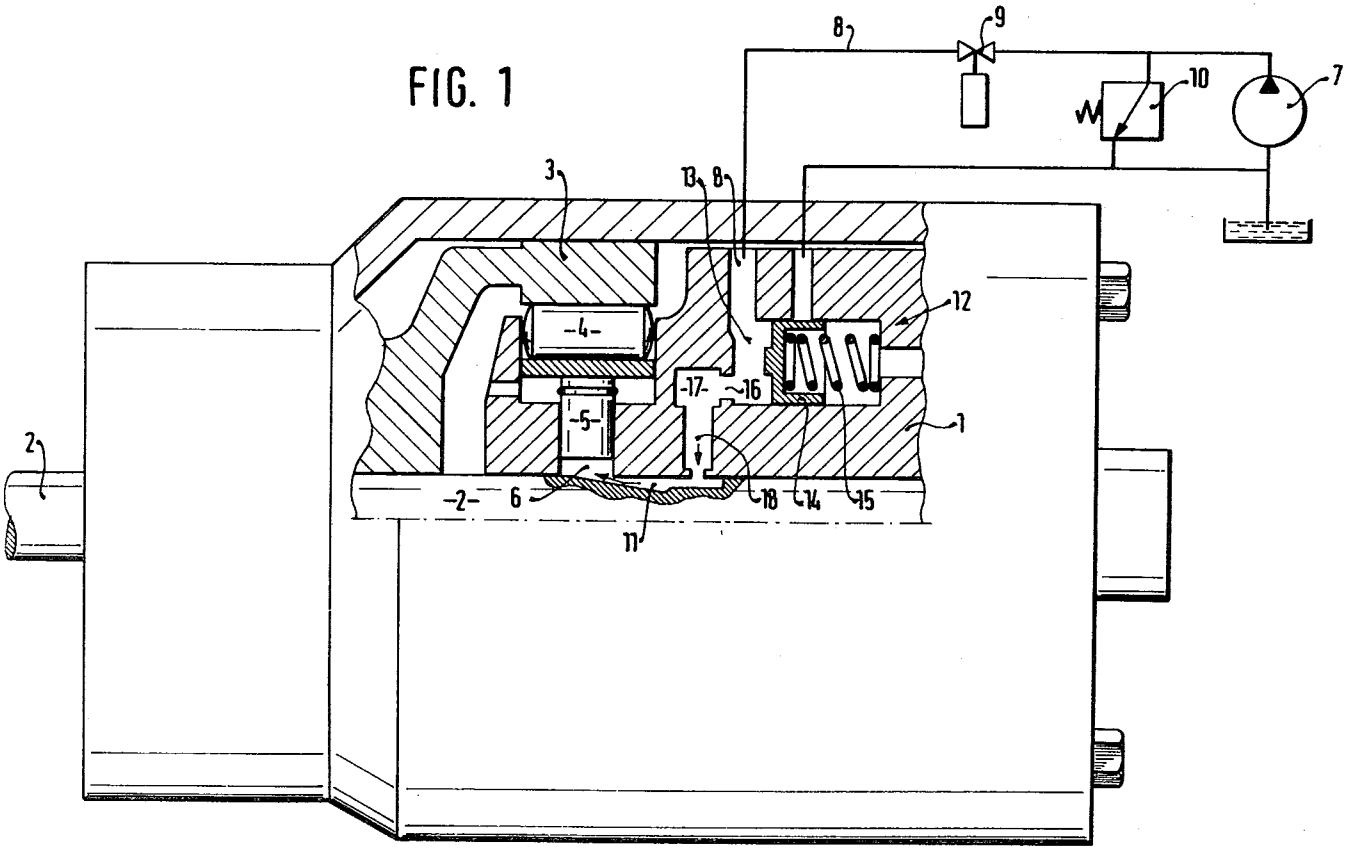
FIG. 1 shows a partial sectional view of an injection pump following a first embodiment of the invention.

Considering first FIG. 1, a rotating distributor 2 operates within the housing 1 of a fuel injection pump, being driven by a cup-like cam 3 at an rpm synchronous with engine rpm and thus, via rollers 4, driving pump pistons 5 disposed radially relative to the distributor so as to effect the compression stroke. Only one pump piston 5 is shown in the drawing, because only that portion of the complete fuel injection pump in which the invention has been realized is shown. Actually, there are preferably at least two pump pistons disposed in a single plane about the distributor 2. The pump work chamber 6 associated with the pump piston 5 is supplied with fuel from a supply pump 7 via a supply conduit 8, which is capable of being shut-off by a magnetic valve 9. The supply pressure of the supply pump 7 is controlled by a pressure control valve 10. Communication between the supply conduit 8 and the pump work chamber 6 is controlled in a known manner by longitudinal grooves 11 provided in the jacket face of the distributor 2.

In accordance with the invention, a fuel reservoir 12 is interposed between the supply conduit 8 and the pump work chamber 6. A reservoir chamber 13 is disposed in the housing and defined by a reservoir piston 14. The reservoir piston 14 is stressed by a reservoir spring 15. The injection pump is provided with only a single reservoir 13, whose outlet discharges into an annular conduit 17, which is part of the supply conduit 8 and extends through the pump housing 1. Radial bores 18 are provided from this annular conduit 17 extending toward the distributor 2 where they lead to and are controlled by the longitudinal grooves 11.

With the aid of FIGS. 1–4, the operation of the first embodiment of this pump will now be described:

In FIG. 1, the intake stroke of the pump piston 5 is shown as just beginning; accordingly, the longitudinal groove 11 has established communication between the reservoir chamber 13 and the pump work chamber 6. As indicated by the arrows in the partially cut-away section of the drawing, the fuel flows out of the reservoir chamber 13 into the annular conduit 17 and from there via the radial bore 18 and the longitudinal groove 11 into the pump work chamber 6. There is created a reservoir pressure, which is determined by the surface area of the piston 14 and the force of the reservoir spring 15, which causes the pump piston 5 to press against its associated roller 4 so that the roller 4 is pressed against the cam ring 3. The supply of fuel into the pump work chamber 6 during this intake stroke has two components: first, a positive displacement by the reservoir piston 14 out of the reservoir chamber 13 and second, as a supplement thereto, the supply effected by the supply pump 7. As a result, it is possible briefly to effect a supply augmentation (volume per unit of time) which is far beyond that which the supply pump 7 alone is capable of providing. The supply pump 7 may accordingly be made small in size since the reservoir can serve to supply extraordinary needs rather than the pump directly. In each case, however, the reservoir pressure 13 must be greater than the pressure required for restoring the initial position of the piston 5; this pressure level is determined by hysteresis and by the counterpressure which arises in the mechanism. The supply conduit 8 is capable of being shut-off by the magnetic valve 9, so that the reservoir piston 14 is then displaced into its outset position, and the engine rapidly comes to a stop because the fuel supply has been cut-off.

Figure 2:
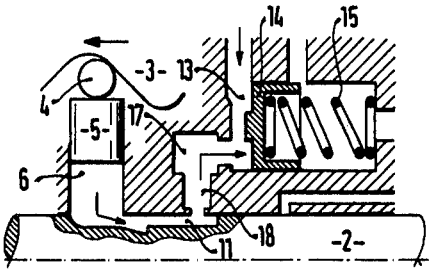
FIGS. 2–4 show partial sectional views of the first exemplary embodiment in several working positions.

Various working positions of the apparatus are shown in FIGS. 1–4. For better understanding of the invention, FIGS. 2–4 have been simplified to show pertinent details only; in particular, the cam 3 is illustrated therein as a roll-off curve. FIG. 2 illustrates the beginning of the compression stroke of the pump piston 5, for which the roller 4 rolls off on the particular edge of the cam 3 which effects a compression stroke. At the beginning of the compression stroke, there is also a connection via the groove 11 to the bore 18, and thus to the annular conduit 17 or reservoir chamber 13 (in accordance with the arrows in the drawing). As a result, the reservoir piston 14, reinforced by the quantity of fuel flowing from the supply pump 7, is displaced counter to the force of the spring 15.

Figure 3:
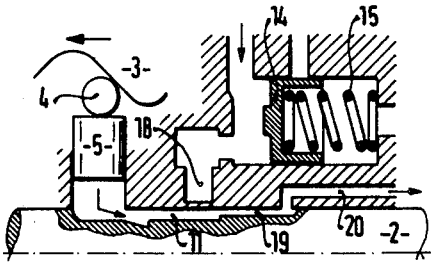

After a further stroke of the pump piston 5, as shown in FIG. 3, the groove 11 is separated from the radial bore 18 and is connected via an elongated channel 19 with a pressure line 20, which leads to the fuel injection nozzles attached to the engine. The further movement of the reservoir piston 14 is effected, counter to the force of the spring, solely by the quantity of fuel flowing from the supply pump 7.

Figure 4:
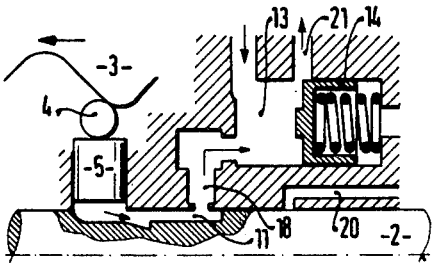

In the terminal position of the reservoir piston 14 shown in FIG. 4, the reservoir piston 14 opens up a relief bore 21, which leads back to the intake side of the supply pump 7. Depending upon the fuel injection quantity specified, the radial bore 18 is again opened by the distributor 2 and the annular groove 11, so that the fuel not proceeding to injection flows back into the reservoir chamber 13. After the roller 4 passes over the apex of the cam 3, which is at the bottom in this case, the intake stroke of the fuel injection pump begins once again, as shown in FIG. 1.

Figure 5:
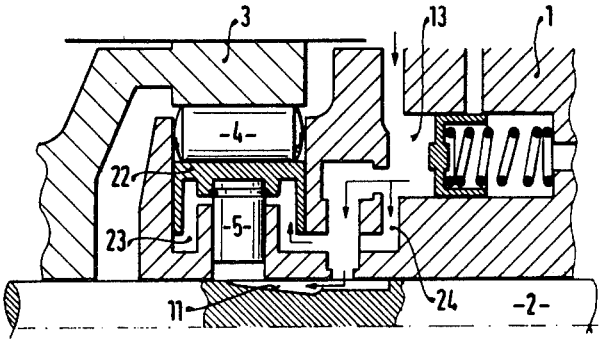
FIG. 5 shows a second exemplary embodiment in partial sectional form revealing details of the fuel injection pump following the invention.

In FIG. 5, a second exemplary embodiment is shown, in which the pump piston 5 is coupled with a piston 22 of larger diameter for the purpose of driving the pump piston 5 during its return stroke (intake stroke). The pump work chamber 23 of this larger piston 22 communicates directly, via a line 24, with the reservoir chamber 13; that is, it is not controlled by the distributor 2 or the groove 11. Otherwise, control of injection is effected as in the first exemplary embodiment. The essential advantages of this direct communication are that no additional throttling effects are brought about via the distributor 2 and that a lower reservoir pressure can be selected, because of the larger surface area of the piston 22 available for returning the piston 5 to its outset position.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. In a fuel injection pump for internal combustion engines having a fuel supply, a rotating distributor having a jacket face, a pump housing, at least one pump piston provided in said pump housing, a pump work chamber partially defined by said pump piston and said pump housing, a fuel supply pump producing a fuel supply output for said pump work chamber, a fuel output quantity being produced by said pump work chamber, a fuel supply conduit having a pressure control valve associated with said fuel supply and said pump work chamber, and at least one control of said supply conduit provided in the jacket face of said rotating distributor to allow fuel to flow to said pump work chamber from said supply conduit, the improvement comprising a fuel supply reservoir assembly including a reservoir chamber downstream of said pressure control valve and having a relief conduit to said fuel supply for producing a working pressure, said assembly disposed in said pump housing between said supply conduit and said rotating distributor, whereby a pressure is created in said fuel supply reservoir by said fuel supply, said working pressure being greater than the pressure required by the re-set of said pump piston, and a spring-biased movable element in said reservoir chamber which is continually pressure relieved and defines an extreme position in which said relief conduit to said fuel supply is opened by said movable element assuming said extreme position against said spring bias, whereby fuel can flow out of said extreme reservoir chamber.

2. A fuel injection pump as defined by claim 1, wherein the pump piston is disposed radially relative to the distributor, a compression stroke is effected toward the distributor, and the pump work chamber is further defined by the distributor.

3. A fuel injection pump as defined by claim 1, wherein a restoring piston is coupled with the pump piston, said restoring piston having a work chamber associated therewith, and a line connects said fuel supply reservoir assembly directly with said restoring piston work chamber, whereby said distributor is bypassed.

4. A fuel injection pump as defined by claim 1, wherein said distributor effects control of an injection quantity and a timing of said injection quantity.

5. A fuel injection pump as defined by claim 1, wherein the the pump piston is operated by means other than a spring.

6. A fuel injection pump as defined by claim 1, wherein said supply pump has a supply output lower than an output quantity produced by said pump work chamber.

7. A fuel injection pump as defined by claim 1, wherein means are provided in said fuel supply conduit to selectively shut-off fuel supply conduit.

* * * * *